US008206078B2

(12) United States Patent
Swenson et al.

(10) Patent No.: US 8,206,078 B2
(45) Date of Patent: Jun. 26, 2012

(54) SYSTEM AND METHOD FOR MONITORING RADIAL MOTION OF A ROTATING SHAFT OF A TURBOCHARGER

(75) Inventors: Kendall Roger Swenson, Erie, PA (US); Daniel Edward Loringer, Erie, PA (US); Larry Gene Anderson, Erie, PA (US); James Robert Mischler, Girard, PA (US); Kirk Heywood, Erie, PA (US)

(73) Assignee: General Electric Company, Schenectady, NY (US)

( * ) Notice: Subject to any disclaimer, the term of this patent is extended or adjusted under 35 U.S.C. 154(b) by 1109 days.

(21) Appl. No.: 12/047,018

(22) Filed: Mar. 12, 2008

(65) Prior Publication Data

US 2009/0232638 A1 Sep. 17, 2009

(51) Int. Cl.
*F04D 27/02* (2006.01)

(52) U.S. Cl. ..... 415/1; 415/104; 415/118; 416/1

(58) Field of Classification Search ..... 415/104, 415/107, 118, 229, 1; 416/61; 417/405, 417/406, 407
See application file for complete search history.

(56) References Cited

U.S. PATENT DOCUMENTS 3,494,679 A * 2/1970 Burdette ..... 384/139
4,256,986 A * 3/1981 Anderson ..... 324/207.15
4,276,002 A * 6/1981 Anderson ..... 417/405
4,490,622 A * 12/1984 Osborn ..... 417/406
4,953,110 A * 8/1990 Chartrand ..... 60/602
5,176,497 A * 1/1993 Deacon et al. ..... 417/407
5,341,097 A * 8/1994 Wu ..... 324/207.2
5,567,056 A 10/1996 Blase et al.
5,789,658 A * 8/1998 Henn et al. ..... 73/1.37
6,418,722 B1 7/2002 Arnold
6,478,553 B1 11/2002 Panos et al.
6,669,372 B1 12/2003 Martin
6,709,160 B1 3/2004 Ward et al.
6,945,047 B2 9/2005 Shea et al.
7,140,848 B2 11/2006 Jaisle
7,189,005 B2 3/2007 Ward

* cited by examiner

*Primary Examiner* — Edward Look
*Assistant Examiner* — Adam Benson
(74) *Attorney, Agent, or Firm* — GE Global Patent Operation; John A. Kramer

(57) ABSTRACT

A system is provided for monitoring radial motion of a rotating shaft of a turbocharger. The turbocharger includes a compressor and a turbine coupled to opposing ends of the shaft. The system includes a thrust collar including a cylindrical portion and a flange configured to radially extend from one end of the cylindrical portion. The thrust collar is configured to rotate with the shaft. A sensor is positioned within a separation of an outer surface of the thrust collar flange, and the sensor is configured to monitor the separation as indicative of the radial motion of the shaft. Additionally, a method is provided for monitoring radial motion of a rotating shaft of a turbocharger.

28 Claims, 5 Drawing Sheets

SYSTEM AND METHOD FOR MONITORING RADIAL MOTION OF A ROTATING SHAFT OF A TURBOCHARGER

BACKGROUND OF THE INVENTION

Turbochargers commonly include a turbine and a compressor linked by a shared rotating shaft. The turbine inlet receives exhaust gases from the engine exhaust manifold causing the turbine wheel to rotate. This rotation drives the compressor, compressing ambient air and delivering it to the air intake of the engine, resulting in a greater amount of the air (for a diesel engine, or air/fuel mixture for a natural gas or gasoline engine) entering into the cylinder. Due to the balance of pressure inside the turbocharger, a considerable axial force tends to push the rotating shaft in the direction of the compressor. These forces are absorbed by the thrust bearing. In addition, under certain conditions of rotating group instability (for example early stages of journal bearing wear or failure), radial forces can be generated. Such radial forces, and other transverse forces which act prior to the radial forces, can result in severe damage to the turbocharger.

Some conventional systems attempt to detect the presence of these radial forces, however these systems do not attempt to detect the earlier presence of transverse forces between the shaft and interior components of the turbocharger, and thus significant damage could have already occurred to the turbocharger. Additionally, some conventional systems do employ speed sensors with the rotating shaft, however these systems do not use these speed sensors to determine whether transverse forces are present.

Thus, it would be advantageous to provide an early warning detection system to monitor the radial motion of the rotating shaft of the turbocharger and/or the presence of these transverse forces, prior to the onset of any damage to the turbocharger. Such a system may, for example, initially determine the early onset of transverse forces (sensed as excessive radial shaft motion) exerted on the rotating shaft, thereby preventing subsequent damage caused by axial forces.

BRIEF DESCRIPTION OF THE INVENTION

In one embodiment of the present invention, a system is provided for monitoring a radial motion of a rotating shaft of a turbocharger. The turbocharger includes a compressor and a turbine coupled to opposing ends of the shaft. The system includes a thrust collar including a cylindrical portion and a flange configured to radially extend from one end of the cylindrical portion. The thrust collar flange is configured to rotate with the shaft. A sensor is positioned within a separation of an outer surface of the thrust collar flange, and the sensor is configured to monitor the separation as indicative of the radial motion of the shaft.

In one embodiment of the present invention, a system is provided for monitoring a radial motion of a rotating shaft. The system includes a turbocharger having a compressor and a turbine coupled to opposing ends of the shaft. The system further includes a thrust collar including an axial portion and a flange configured to radially extend from one end of the axial portion. The thrust collar flange is configured to rotate with the shaft. The system further includes a sensor positioned within a separation of an outer surface of the thrust collar flange, and the sensor is configured to monitor the separation as indicative of the radial motion of the shaft.

In one embodiment of the present invention, a method is provided for monitoring a radial motion of a rotating shaft of a turbocharger. The turbocharger includes a compressor and a turbine coupled to opposing ends of the shaft. The method includes providing a thrust collar including a cylindrical portion and a flange configured to radially extend from one end of the cylindrical portion. The thrust collar flange is configured to rotate with the shaft. The method further includes positioning a sensor within a separation of an outer surface of the thrust collar flange, and monitoring the separation as indicative of the radial motion of the shaft.

BRIEF DESCRIPTION OF THE DRAWINGS

A more particular description of the embodiments of the invention briefly described above will be rendered by reference to specific embodiments thereof that are illustrated in the appended drawings. Understanding that these drawings depict only typical embodiments of the invention and are not therefore to be considered to be limiting of its scope, the embodiments of the invention will be described and explained with additional specificity and detail through the use of the accompanying drawings in which.

DETAILED DESCRIPTION OF THE INVENTION

In describing particular features of different embodiments of the present invention, number references will be utilized in relation to the figures accompanying the specification. Similar or identical number references in different figures may be utilized to indicate similar or identical components among different embodiments of the present invention.

Figure 1:
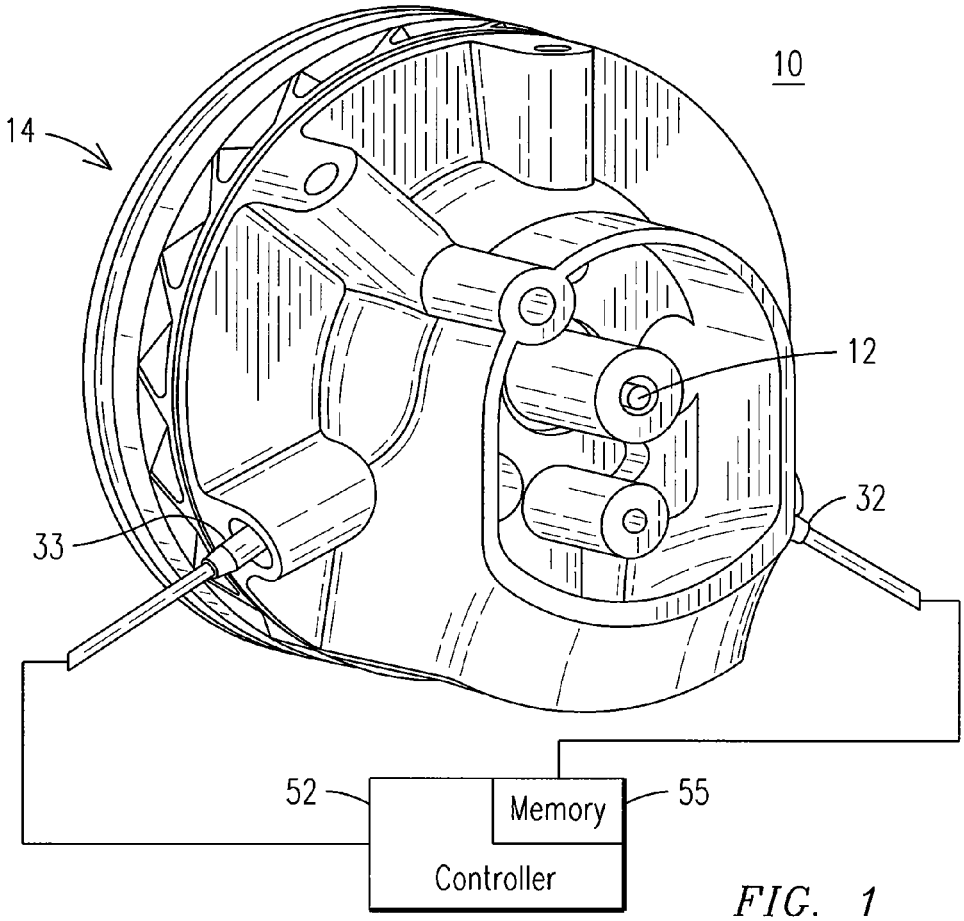
FIG. 1 is an end perspective view of an exemplary embodiment of a system for monitoring radial motion of a rotating shaft of a turbocharger.

FIG. 1 illustrates an exemplary embodiment of a system 10 for monitoring radial motion of a rotating shaft 12 of a turbocharger 14. The turbocharger 14 includes a compressor and a turbine coupled to opposing ends 20,22 (FIGS. 2-3) of the shaft 12. Although the embodiments of the present invention involve the rotating shaft of a turbocharger, these embodiments may be employed to monitor the radial motion of other shafts, or other devices apart from shafts which need to maintain a proper alignment.

Figure 2:
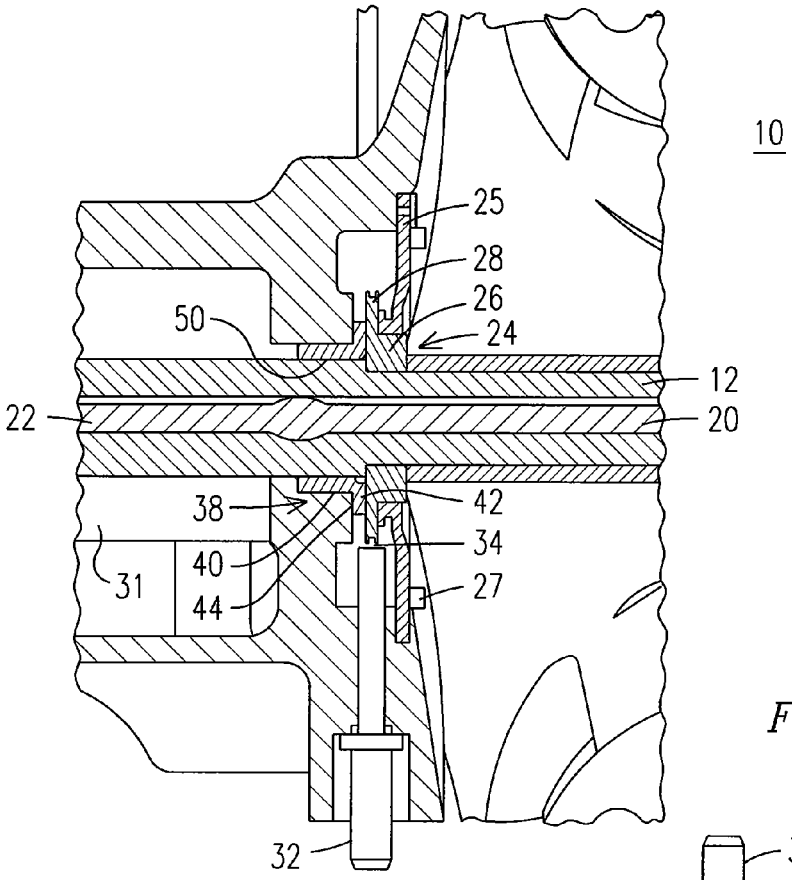
FIG. 2 is a cross-sectional side view of the system for monitoring radial motion of a rotating shaft of a turbocharger illustrated in FIG. 1.
Figure 3:
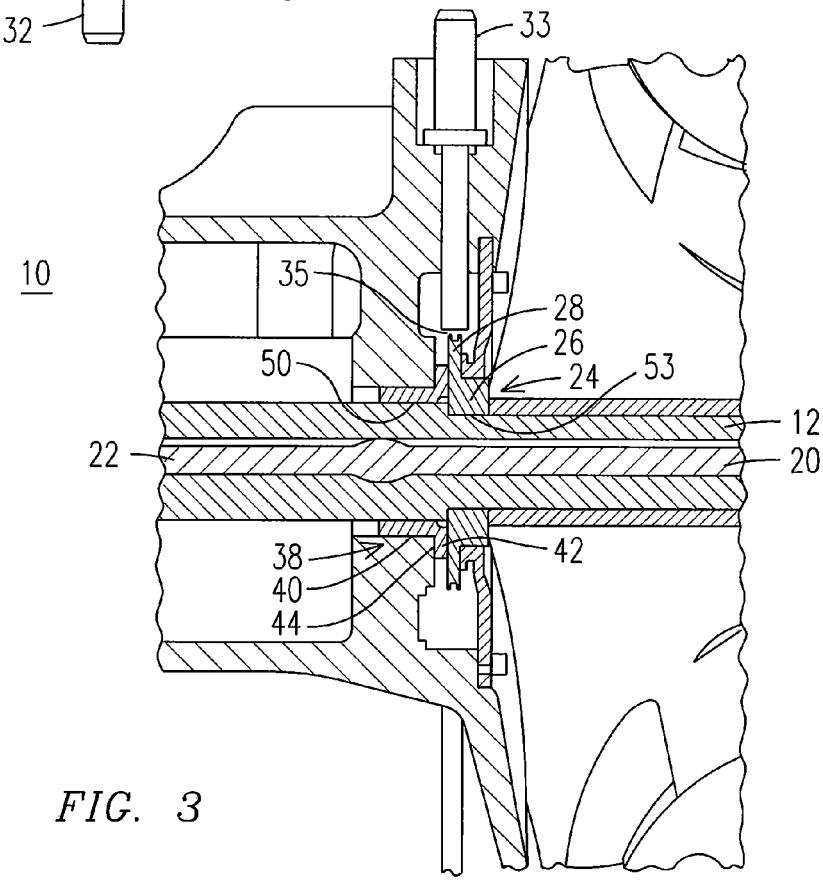
FIG. 3 is a cross-sectional side view of the system for monitoring radial motion of a rotating shaft of a turbocharger illustrated in FIG. 1.
Figure 4:
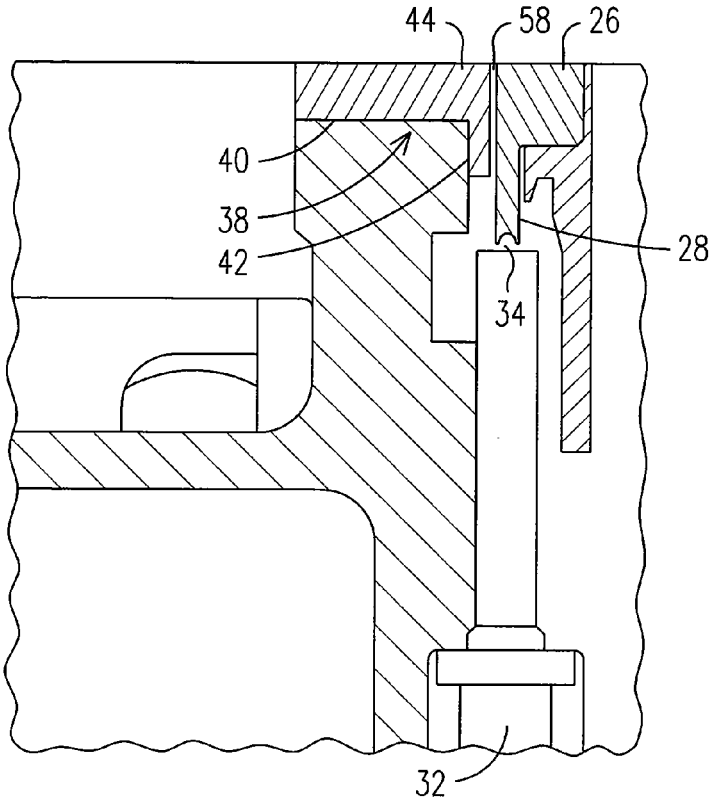
FIG. 4 is a partial cross-sectional side view of the cross-sectional side view illustrated in FIG. 2.
Figure 5:
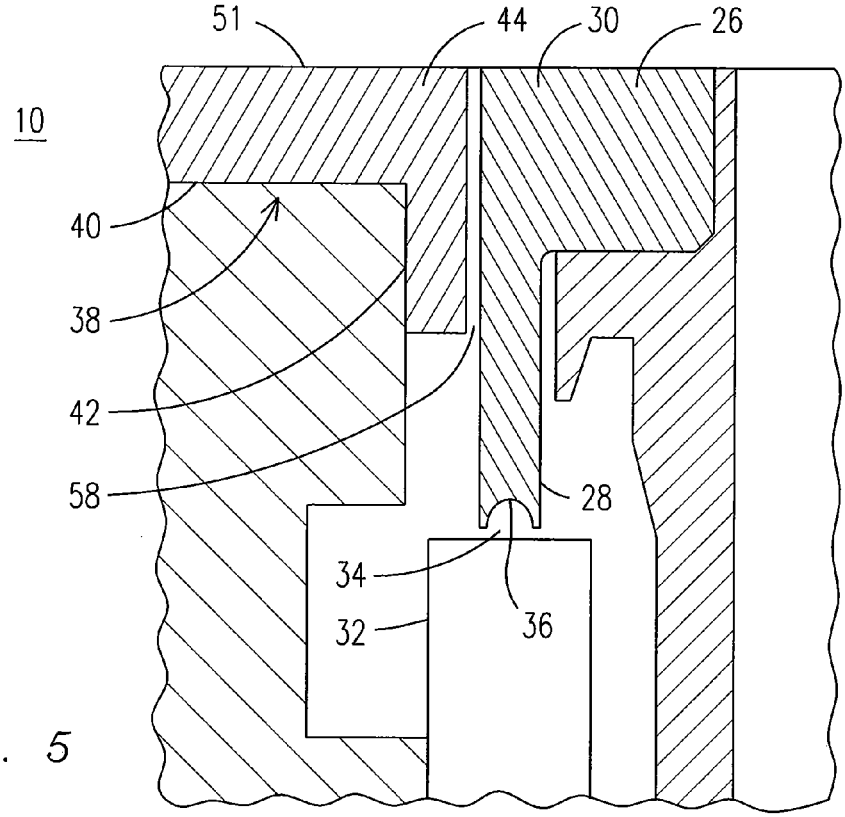
FIG. 5 is a partial cross-sectional side view of the cross-sectional side view illustrated in FIG. 2.

As illustrated in FIGS. 2-5, the system 10 further includes a thrust collar 24 including a cylindrical portion 26 and a flange 28 radially extending from one end 30 of the cylindrical portion 26. The thrust collar 24 rotates with the shaft 12. An inner portion 53 of an opening in the thrust collar 24 is rotatably coupled to the shaft 12 such that the thrust collar 24 rotates with the shaft 12. A pair of sensors 32,33 are positioned transverse to the shaft 12 (FIG. 1). The pair of sensors 32 (FIG. 2, 4-5), 33 (FIG. 3) are positioned within a respective separation 34,35 of an outer surface 36 of the thrust collar flange 28. The sensors 32,33 monitor the respective separation 34,35, as indicative of the radial motion of the shaft 12. Although FIGS. 1-3 illustrate a pair of sensors 32,33 within the system 10, only one sensor may be utilized or more than two sensors may be utilized to monitor the separation between the sensors and the outer surface of the thrust collar flange.

The exemplary embodiment of the system illustrated in FIGS. 2-5 further includes a journal bearing 38 having a cylindrical portion 40 and a flange 42 configured to radially extend from one end 44 of the cylindrical portion 40. The shaft 12 passes through a respective opening in the thrust collar 24 and the journal bearing 38, and an inner diameter 50 separates the shaft from an inner portion 51 of the opening in the journal bearing 38. The thrust collar 24 and the journal bearing 38 are positioned such that the thrust collar flange 28 and the journal bearing flange 42 are adjacent, with a lubricant 58 provided between the thrust collar flange 28 and journal bearing flange 42.

In addition to the thrust collar 24 and the journal bearing 38, a compressor seal 25 is supported by compressor seal bolts 27 toward the end 20 of the shaft 12 in the direction of the compressor. Additionally, a turbine casing 31 is provided to enclose the turbine, and the turbine casing 31 is positioned toward the opposing end 22 of the shaft 12 in the direction of the turbine.

As illustrated in FIG. 1, the exemplary embodiment of the system 10 further includes a controller 52 coupled to the pair of sensors 32,33 to receive data of the respective separation 34,35 from the sensors 32,33. As discussed above, as few as one sensor may be utilized for each turbocharger 14, or three or more sensors may be utilized for each measurement plane desired in the turbocharger 14, where the greater number of sensors permits the detection of a greater number of displacement modes. The controller 52 determines whether the inner diameter 50 is within a predetermined range based on the separation 34,35 data. The predetermined range of the inner diameter 50 may be stored in a memory 55 within the controller, for example. The controller 52 is capable of converting the predetermined range of the inner diameter 50 into a predetermined range of the separation 34,35 between the thrust collar flange 28 and the sensors 32,33, and utilizing the predetermined range of the separation 34,35 when monitoring the separation 34,35 data.

Figure 6:
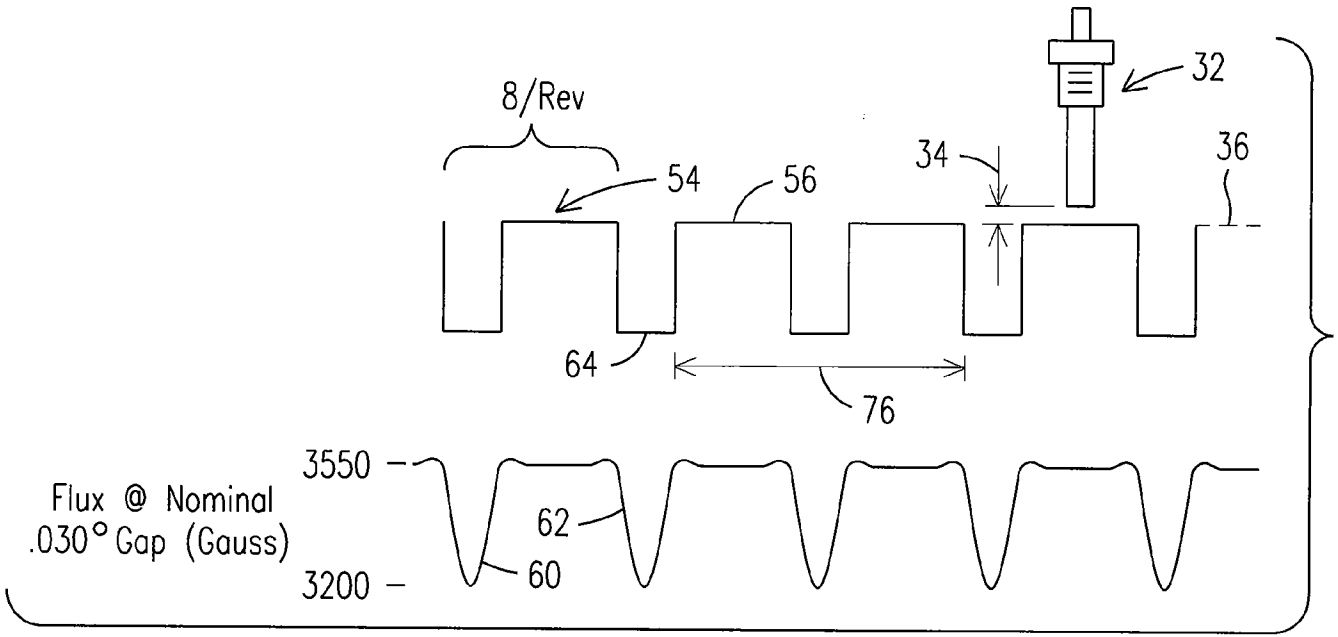
FIG. 6 is an exemplary plot of the spatial magnetic profile and associated magnetic flux of the outer surface of the thrust collar flange through the sensor illustrated in FIG. 2, at a nominal separation.

FIG. 6 illustrates an exemplary embodiment of a profile of the outer surface 36 of the thrust collar flange 28. In the exemplary embodiment of FIG. 6, the outer surface 36 may include a plurality of spaced-apart portions 54,56, and the sensor 32 is a magnetic sensor which is activated when a respective portion 54,56 is positioned within a proximate distance of the sensor, as the thrust collar flange 28 rotates with respect to the sensor 32. For example, as illustrated in the exemplary embodiment of FIG. 6, the sensor 32 is configured to have an increased response 60 upon one of the portions 54,56 passing by the sensor 32, and the sensor 32 is configured to have a decreased response 62 upon a gap portion 64 between the spaced-apart portions 54,56 passing by the sensor 32. As further illustrated in the exemplary embodiment of FIG. 6, a magnitude of the increased and decreased response 60,62 is based on the separation 34 between the sensor 32 and the outer surface 36 of the thrust collar flange 28.

Additionally, the magnitude of the increased and decreased response 60,62 is based on a relative radial shift of the response profile for a respective portion 54,56 between consecutive revolutions of the thrust collar flange 28, which is based on a radial position of the respective portion 54,56 relative to the sensor 32 at each revolution pass. In an additional exemplary embodiment, the sensors 32,33 are configured to respond to a variance in magnetic flux passing through the sensors 32,33, where the portions 54,56 within the outer surface 36 include a ferrous material such that the increased response 60 reflects an increase in a magnetic flux through the sensors 32,33 and the decreased response 62 reflects a decrease in the magnetic flux through the sensors 32,33.

Figure 7:
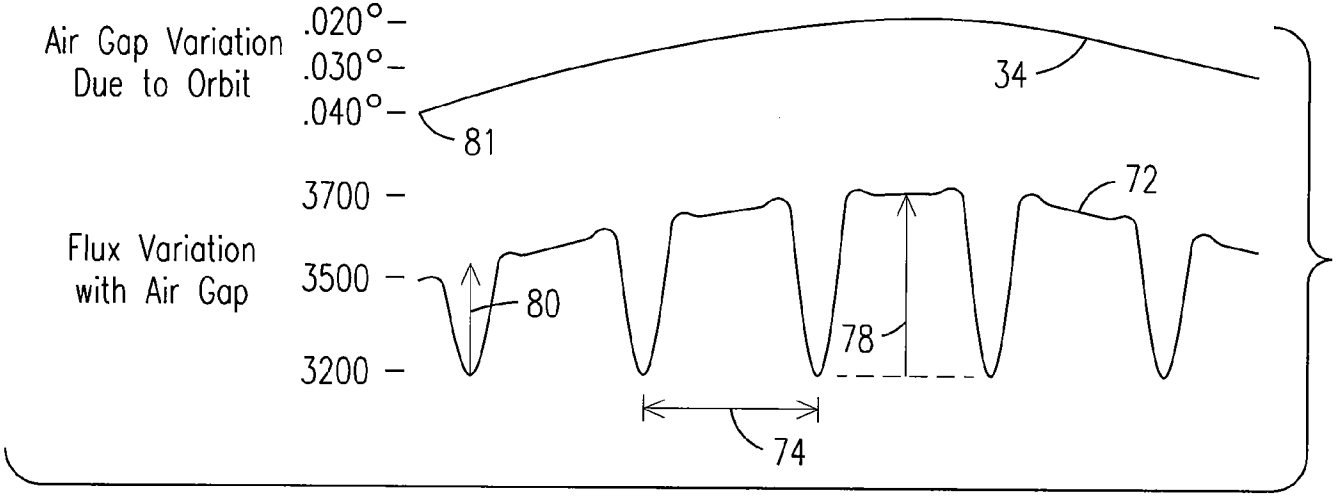
FIG. 7 is an exemplary plot of a varying separation and associated varying amplitude magnetic flux, from the outer surface of the thrust collar flange to the sensor illustrated in FIG. 2.
Figure 8:
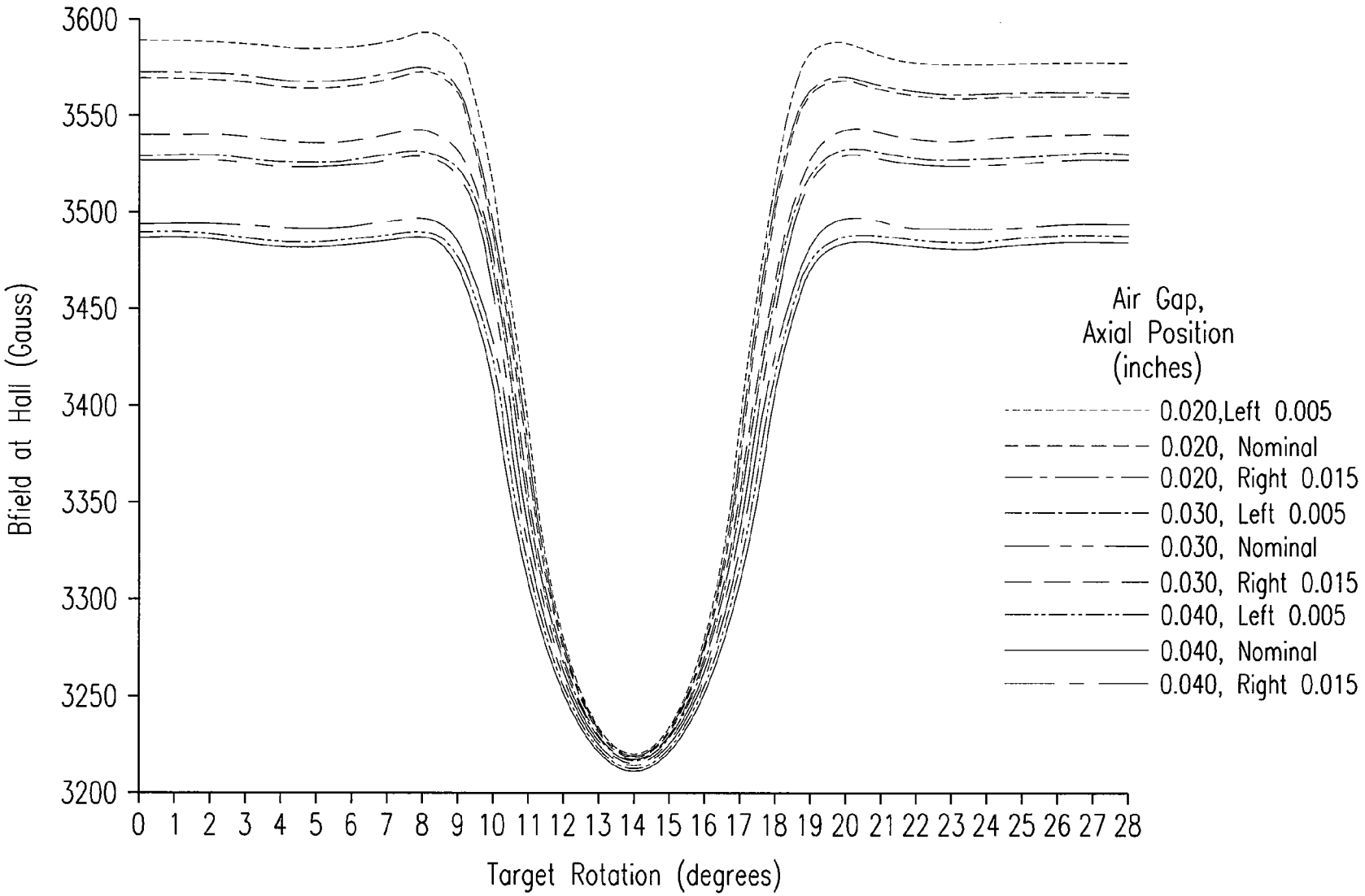
FIG. 8 is an exemplary plot of a plurality of magnetic flux profiles through the sensor versus an angular degree of rotation of the turbocharger shaft, for various separations and axial positions between the outer surface of the thrust collar flange and the sensor.

In the exemplary embodiment illustrated in FIG. 7, during the rotation of the shaft 12, the plurality of portions 54,56 rotate within the separation 34 of the magnetic sensor 32, and the magnetic sensor 32 is configured to output a varying electrical response 72, such as a sinusoidal variation, for example, to the controller 52, based on the magnetic flux passing through the sensor 32. Although FIG. 7 illustrates a sinusoidal response from the sensor, the varying electrical response may not be sinusoidal, based on the radial motion of the shaft. The varying response 72 has a frequency 74 based on the spacing 76 between the portions 54,56 along the outer surface 36 (see FIGS. 6-7), and an amplitude 78 based on the separation 34 of each respective portion 54,56 to the sensor 32. FIG. 8 illustrates an exemplary embodiment of magnetic flux passing through the sensor 32 over a portion of a revolution of the shaft 12, for a number of initial separations 34 (0.020, 0.030, 0.040 inches) and initial axial positions (left 0.005, nominal, right 0.015) between the sensor 32 and the portions 54,56.

In an exemplary embodiment, the contour of the outer surface 36 of the thrust collar can be designed to make the flux variation at the sensor tip uniform (over a limited distance) to axial displacement of the rotor assembly. This will allow the sensor system to only respond to the radial motions of the rotor assembly (which is the desired mode of operation). Although FIGS. 2-5 illustrate one thrust collar and one journal bearing encircling the shaft, more than one thrust collar and more than one journal bearing may be utilized to encircle the shaft, with at least one sensor positioned adjacent to each thrust collar, as discussed above, and coupled to the controller. In an exemplary embodiment, a magnitude of the increased and decreased response 60,62 is based on the separation 34,35 between the sensors 32,33 and the outer surface 36 of the thrust collar flange 28. Additionally, the magnitude of the increased and decreased response 60,62 is insensitive to a relative shift of the increased and decreased response 60,62 for a respective portion 54,56 between consecutive revolutions of the thrust collar flange 28 based on an axial position of the respective portion 54,56 relative to the sensors 32,33.

The controller 52 compares the sensor 32,33 data for a respective portion 54,56 positioned adjacent to the sensor 32,33 on respective revolutions of the thrust collar flange 28 to determine a variation in the respective separation 34,35 of the respective portion 54,56 to the sensor 32,33. Since the outer surface 36 of the thrust collar flange 28 will naturally have a non-uniform outer diameter, the respective separation 34,35 of the respective portion 54,56 to the sensors 32,33 will vary. Thus, the controller 52 compares the sensor 32,33 data for a respective portion 54,56 on respective revolutions in order to consider relevant factors in determining the variation of the separation 34,35 between the respective portion 54,56 and the sensors 32,33. For example, portion #1 may have a separation of X and portion #2 may have a separation of Y from the respective sensors 32,33 on several revolutions of the thrust collar flange 28, and a sample predetermined range of ±/−20% from this nominal separation. In this example, the controller 52 determines that the portion #1 has a separation between 0.8X-1.2X and the portion #2 has a separation of 0.8Y-1.2Y, for example. If the controller 52 determines that either separation 34,35 falls outside of the respective 0.8X-1.2X or 0.8Y-1.2Y, which corresponds to a predetermined range for the inner diameter 50, any of a number of cautionary actions may be taken, such as alerting the locomotive operator with a warning signal via. a display, automatically shutting down the engine, and any other similar cautionary measure to prevent damage to the turbocharger 14. As previously discussed, the controller 52 correlates the predetermined range of the separation 34,35 between the portions 54,56 and the outer surface 36 with the predetermined range of the inner diameter 50, which is a key factor in shaft 12 alignment. In an exemplary embodiment, the controller 52 may combine the separation 34,35 data from the two sensors 32,33 to generate the waveform of the varying electrical response 72, or may utilize the separation 34,35 data from one sensor 32,33 to generate the waveform 72, for example. The amplitude 78 of the sinusoidal waveform of the varying electrical response 72 can vary from a nominal amplitude 80 defined by the sinusoidal response when the separation is a nominal separation 81, and the varying amplitude is based on a variance of the separation 34,35 between a respective portion 54,56 and the sensors 32,33 during respective revolutions of the thrust collar flange 28. In the exemplary embodiment, the controller 52 monitors the varying amplitude of the varying response 72 and compares the varying amplitude with a predetermined maximum amplitude deviation from the nominal amplitude 80. The predetermined maximum amplitude deviation is indicative that the inner diameter 50 has exceeded the predetermined range. Upon determining that the varying amplitude has deviated from the nominal amplitude 80 by greater than the predetermined maximum amplitude, the controller 52 transmits a warning signal to a control panel, for example.

Figure 9:
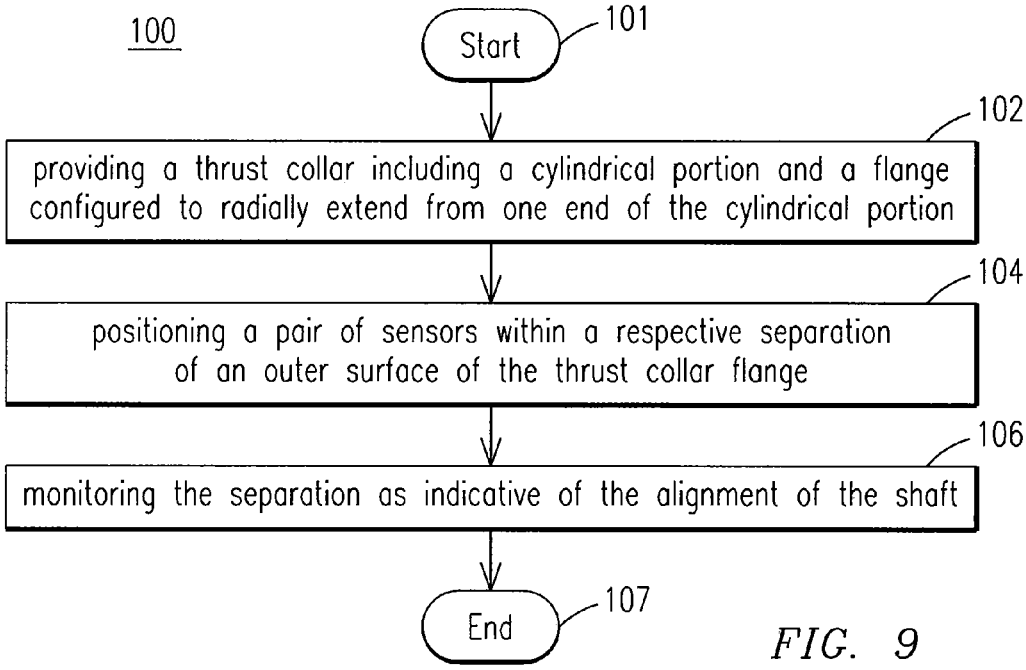
FIG. 9 is a flow chart illustrating an exemplary embodiment of a method for monitoring radial motion of a rotating shaft of a turbocharger.

FIG. 9 illustrates an exemplary embodiment of a method 100 for monitoring radial motion of a rotating shaft 12 of a turbocharger 14. The method 100 begins at 101 by providing 102 a thrust collar 24 including a cylindrical portion 26 and a flange 28 configured to radially extend from one end 30 of the cylindrical portion 26. The thrust collar 24 is configured to rotate with the shaft 12. The method 100 further includes positioning 104 a pair of sensors 32,33 within a respective separation 34,35 of an outer surface 36 of the thrust collar flange 28. The method 100 further includes monitoring 106 the separation 34,35 as indicative of the radial motion of the shaft 12, before ending at 107.

This written description uses examples to disclose embodiments of the invention, including the best mode, and also to enable any person skilled in the art to make and use the embodiments of the invention. The patentable scope of the embodiments of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

That which is claimed is:

1. A system for monitoring radial motion of a rotating shaft of a turbocharger, said turbocharger including a compressor and a turbine coupled to opposing ends of said shaft, said system comprising:

a thrust collar including a cylindrical portion and a flange configured to radially extend from one end of said cylindrical portion, said thrust collar being configured to rotate with said shaft; and a sensor positioned adjacent to the thrust collar flange with a separation between the sensor and an outer surface of said thrust collar flange, said sensor configured to monitor said separation as indicative of said radial motion of said shaft, said radial motion indicative of alignment of said shaft.

2. The system of claim 1, further comprising:

a journal bearing including a cylindrical portion and a flange configured to radially extend from one end of said cylindrical portion; and said shaft is configured to pass through a respective opening in said thrust collar and said journal bearing; an inner diameter separates said shaft from an inner portion of said opening in said journal bearing.

3. The system of claim 2, wherein an inner portion of said opening in said thrust collar is rotatably coupled to said shaft such that said thrust collar is configured to rotate with said shaft.

4. The system of claim 2, further comprising a controller coupled to said sensor to receive data of said separation from said sensor, said controller is configured to determine whether said inner diameter is within a predetermined range based on said separation data.

5. The system of claim 4, wherein said sensor is a magnetic sensor, said outer surface including a plurality of spaced-apart portions to activate said sensor.

6. The system of claim 5, wherein said controller is configured to compare said sensor data for a respective portion positioned adjacent to said sensor on respective revolutions of said thrust collar flange to determine said separation of the respective portion to the sensor.

7. The system of claim 5, wherein said sensor is configured to have an increased response upon one of said spaced-apart portions passing by said sensor, said sensor is configured to have a decreased response upon a gap between said spaced-apart portions passing by said sensor.

8. The system of claim 7, wherein a magnitude of said increased and decreased response is based on said separation between said sensor and said outer surface of said thrust collar flange, and a relative shift of said increased and decreased response for a respective portion between consecutive revolutions of said thrust collar flange is based on a radial position of said respective portion relative to said sensor.

9. The system of claim 8, wherein said sensor is configured to respond to a variance in magnetic flux passing through said sensor, the one of said spaced-apart portions within said outer surface includes a ferrous material such that said increased response reflects an increase in a magnetic flux through said sensor and said decreased response reflects a decrease in said magnetic flux through said sensor.

10. The system of claim 9, wherein during said rotation of the shaft, said plurality of spaced-apart portions are configured to rotate within said separation of said magnetic sensor, and said magnetic sensor is configured to output a varying response to said controller, said varying response having a frequency based on a spacing between said plurality of spaced-apart portions along said outer surface, and an amplitude based on said respective separation of each respective portion to said sensor.

11. The system of claim 10, wherein said amplitude of said varying response is configured to vary from a nominal amplitude defined by a baseline response when said separation is a nominal separation, said varying amplitude is based on a variance of said separation between a respective portion and said sensor during respective revolutions of said thrust collar flange.

12. The system of claim 11, wherein said controller is configured to monitor said varying amplitude of said varying response and compare said varying amplitude with a predetermined maximum amplitude deviation from said nominal amplitude, said predetermined maximum amplitude deviation being indicative that said inner diameter has exceeded said predetermined range, wherein upon determining that said varying amplitude has deviated from said nominal amplitude by greater than said predetermined maximum amplitude deviation, said controller transmits a warning signal to a control panel.

13. The system of claim 7, wherein a magnitude of said increased and decreased response is based on said separation between said sensor and said outer surface of said thrust collar flange, and is insensitive to a relative shift of said increased and decreased response for a respective portion between consecutive revolutions of said thrust collar flange based on an axial position of said respective portion relative to said sensor.

14. The system of claim 2, said thrust collar and said journal bearing are positioned such that said thrust collar flange and said journal bearing flange are adjacent, with a lubricant provided between said thrust collar flange and journal bearing flange.

15. The system of claim 1, further comprising:

one or more additional sensors positioned within the separation of the outer surface of said thrust collar flange, the one or more additional sensors configured to monitor said separation as indicative of said radial motion of said shaft.

16. A system for monitoring a radial motion of a rotating shaft, comprising:

a turbocharger including a compressor and a turbine coupled to opposing ends of said shaft;

a thrust collar including an axial portion and a flange configured to radially extend from one end of said axial portion, said thrust collar being configured to rotate with said shaft; and a sensor positioned adjacent to the thrust collar flange with a separation between the sensor and an outer surface of said thrust collar flange, said sensor configured to monitor said separation as indicative of said radial motion of said shaft, said radial motion indicative of alignment of said shaft.

17. The system of claim 16, further comprising:

a journal bearing including an axial portion and a flange configured to radially extend from one end of said axial portion, wherein said shaft passes through an opening in said journal bearing, said shaft being separated by an inner diameter from an inner portion of said opening in said journal bearing.

18. The system of claim 17, wherein an inner portion of an opening in said thrust collar is rotatably coupled to said shaft such that said thrust collar is configured to rotate with said shaft.

19. The system of claim 18, further comprising a controller coupled to said sensor to receive data of said separation from said sensor, said controller is configured to determine whether said inner diameter is within a predetermined range based on said separation data.

20. The system of claim 16, further comprising:

one or more additional sensors positioned within the separation of the outer surface of said thrust collar flange, the one or more additional sensors configured to monitor said separation as indicative of said radial motion of said shaft.

21. A method for monitoring a radial motion of a rotating shaft of a turbocharger, said turbocharger including a compressor and a turbine coupled to opposing ends of said shaft, said method comprising:

providing a thrust collar including a cylindrical portion and a flange configured to radially extend from one end of said cylindrical portion, said thrust collar being configured to rotate with said shaft;

positioning a sensor with a separation between the sensor and an outer surface of said thrust collar flange; and monitoring said separation as indicative of said radial motion of said shaft and alignment of said shaft.

22. The method claim 21, further comprising:

providing a journal bearing including a cylindrical portion and a flange configured to radially extend from one end of said cylindrical portion; and passing said shaft through a respective opening in said thrust collar and said journal bearing, wherein an inner diameter separates said shaft from an inner portion of said opening in said journal bearing.

23. The method of claim 22, further comprising:

analyzing data of said separation from said sensor with a controller; and determining whether said inner diameter is within a predetermined range based on said separation data with said controller.

24. The method of claim 23, wherein said sensor is a magnetic sensor, said providing the thrust collar further comprises forming a plurality of spaced-apart portions along said outer surface of said thrust collar flange.

25. The method of claim 24, further comprising:

comparing said sensor data for a respective portion positioned adjacent to said sensor on respective revolutions of said thrust collar flange; and determining said separation of the respective portion to the sensor.

26. The method of claim 25, wherein during said rotation of the shaft, said plurality of portions are configured to rotate within said separation of said magnetic sensor, and said magnetic sensor is configured to output a varying response to said controller, said varying response having a frequency based on a spacing between said portions along said outer surface, and an amplitude based on said respective separation of each respective portion to said sensor, said amplitude configured to vary from a nominal amplitude defined by a baseline response when said separation is a nominal separation, said varying amplitude is based on a variance of said separation between a respective portion and said sensor during respective revolutions of said thrust collar flange.

27. The method of claim 26, further comprising, monitoring said varying amplitude of said varying response and comparing said varying amplitude with a predetermined maximum amplitude deviation from said nominal amplitude, said predetermined maximum amplitude deviation being indicative that said inner diameter has exceeded said predetermined range, wherein upon determining that said varying amplitude has deviated from said nominal amplitude by greater than said predetermined maximum amplitude deviation, transmitting a warning signal to a control panel.

28. The method of claim 21, wherein the sensor is positioned adjacent to the thrust collar flange.

* * * * *